US008061453B2

(12) United States Patent
Cariveau et al.

(10) Patent No.: US 8,061,453 B2
(45) Date of Patent: Nov. 22, 2011

(54) DRILL BIT WITH ASYMMETRIC GAGE PAD CONFIGURATION

(75) Inventors: Peter T. Cariveau, Draper, UT (US); Bala Durairajan, Houston, TX (US)

(73) Assignee: Smith International, Inc., Houston, TX (US)

( * ) Notice: Subject to any disclaimer, the term of this patent is extended or adjusted under 35 U.S.C. 154(b) by 294 days.

(21) Appl. No.: 11/753,268

(22) Filed: May 24, 2007

(65) Prior Publication Data

US 2007/0272445 A1 Nov. 29, 2007

Related U.S. Application Data

(60) Provisional application No. 60/808,873, filed on May 26, 2006.

(51) Int. Cl.
*E21B 10/00* (2006.01)

(52) U.S. Cl. ..... 175/398; 175/376

(58) Field of Classification Search ..... 175/408, 175/399, 398, 343, 376
See application file for complete search history.

(56) References Cited

U.S. PATENT DOCUMENTS

| | | | | |
|---|---|---|---|---|
| 5,937,958 | A | 8/1999 | Mensa-Wilmot et al. | |
| 6,253,863 | B1 | 7/2001 | Mensa-Wilmot et al. | |
| 6,290,007 | B2 * | 9/2001 | Beuershausen et al. | 175/408 |
| 6,308,790 | B1 | 10/2001 | Mensa-Wilmot et al. | |
| 6,394,200 | B1 * | 5/2002 | Watson et al. | 175/385 |
| 6,684,967 | B2 | 2/2004 | Mensa-Wilmot et al. | |
| 6,739,416 | B2 * | 5/2004 | Presley et al. | 175/385 |
| 2001/0000885 | A1 | 5/2001 | Beuershausen et al. | |
| 2002/0079139 | A1 * | 6/2002 | Mensa-Wilmot et al. | 175/408 |
| 2006/0254829 | A1 * | 11/2006 | Cariveau | 175/415 |

FOREIGN PATENT DOCUMENTS

| | | |
|---|---|---|
| GB | 2328698 | 3/1999 |
| GB | 2351513 | 1/2001 |
| GB | 2355744 | 5/2001 |
| GB | 2426020 | 11/2006 |

OTHER PUBLICATIONS

British Search Report for Appl. No. GB0710006.8 dated Aug. 24, 2007; (2 p.).
Response to UK Search and Examination Report for Appl. No. 0710006.8dated Aug. 28, 2007 (15 p.).
Canadian Office Action dated Nov. 30, 2009 for Appl. No. 2,590,439 (38 p.).
Response Canadian Office Action dated Nov. 30, 2009 for Appl. No. 2,590,439 (55 p.).

* cited by examiner

*Primary Examiner* — Jennifer H Gay
*Assistant Examiner* — Sean Andrish
(74) *Attorney, Agent, or Firm* — Christie, Parker & Hale, LLP

(57) ABSTRACT

A drill bit for drilling a borehole in earthen formations. In an embodiment, the bit comprises a bit body having a bit axis and a bit face. In addition, the bit comprises a pin end extending from the bit body opposite the bit face. Further, the bit comprises a plurality of gage pads extending from the bit body, wherein each gage pad includes a radially outer gage-facing surface. The gage-facing surfaces of the plurality of gage pads define a gage pad circumference that is centered relative to a gage pad axis, the gage pad axis being substantially parallel to the bit axis and offset from the bit axis.

31 Claims, 6 Drawing Sheets

DRILL BIT WITH ASYMMETRIC GAGE PAD CONFIGURATION

CROSS-REFERENCE TO RELATED APPLICATIONS

This application claims benefit of U.S. provisional application Ser. No. 60/808,873 filed May 26, 2006, and entitled "Drill Bit With Gage Pad Configuration To Enhance Off-Axis Drilling Capability," which is hereby incorporated herein by reference in its entirety.

STATEMENT REGARDING FEDERALLY SPONSORED RESEARCH OR DEVELOPMENT

Not Applicable.

BACKGROUND

1. Field of the Invention

The invention relates generally to earth-boring bits used to drill a borehole for the ultimate recovery of oil, gas, or minerals. More particularly, the invention relates to drill bits designed to shift the orientation of its axis in a predetermined direction as it drills. Still more particularly, the invention relates to a drill bit having inclination reducing or "dropping" tendencies.

2. Background of the Invention

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created will have a diameter generally equal to the diameter or "gage" of the drill bit.

Many different types of drill bits and cutting structures for bits have been developed and found useful in drilling such boreholes. Two predominate types of rock bits are roller cone bits and fixed cutter (or rotary drag) bits. Many fixed cutter bit designs include a plurality of blades that project radially outward from the bit body and form flow channels there between. Typically, cutter elements are grouped and mounted on the several blades.

The cutter elements disposed on the several blades of a fixed cutter bit are typically formed of extremely hard materials and include a layer of polycrystalline diamond ("PD") material. In the typical fixed cutter bit, each cutter element or assembly comprises an elongate and generally cylindrical support member which is received and secured in a pocket formed in the surface of one of the several blades. A cutter element typically has a hard cutting layer of polycrystalline diamond or other superabrasive material such as cubic boron nitride, thermally stable diamond, polycrystalline cubic boron nitride, or ultrahard tungsten carbide (meaning a tungsten carbide material having a wear-resistance that is greater than the wear-resistance of the material forming the substrate) as well as mixtures or combinations of these materials. The cutting layer is exposed on one end of its support member, which is typically formed of tungsten carbide. For convenience, as used herein, reference to "PD bit" or "PD cutter element" refers to a fixed cutter bit or cutter element employing a hard cutting layer of polycrystalline diamond or other superabrasive material such as cubic boron nitride, thermally stable diamond, polycrystalline cubic boron nitride, or ultrahard tungsten carbide.

While the bit is rotated, drilling fluid is pumped through the drill string and directed out of the drill bit. The fixed cutter bit typically includes nozzles or fixed ports spaced about the bit face that serve to inject drilling fluid into the flow passageways between the several blades. The flowing fluid performs several important functions. The fluid removes formation cuttings from the bit's cutting structure. Otherwise, accumulation of formation materials on the cutting structure may inhibit or prevent the penetration of the cutting structure into the formation. In addition, the fluid removes cut formation materials from the bottom of the borehole. Failure to remove formation materials from the bottom of the borehole may result in subsequent passes by the cutting structure to re-cut the same materials, thus reducing cutting rate and potentially increasing wear on the cutting surfaces. The drilling fluid and cuttings removed from the bit face and from the bottom of the borehole are forced and carried to the surface through the annulus that exists between the drill string and the borehole sidewall. Still further, the drilling fluid removes frictional heat from the cutter elements in order to prolong cutter element life. Thus, the number and placement of drilling fluid nozzles, and the resulting flow of drilling fluid, may significantly impact the performance of the drill bit.

Depending on the location and orientation of the target formation or pay zone, directional drilling (e.g., horizontal drilling) with the drill bit may be desired. In general, directional drilling involves deviation of the borehole from vertical (i.e., drilling a borehole in a direction other than substantially vertical), and is typically accomplished by drilling, for at least some period of time, in a direction not parallel with the bit axis. Directional drilling capabilities have improved as advancements in measurement while drilling (MWD) technologies have enabled drillers to better track the position and orientation of the wellbore. In addition, more extensive and more accurate information about the location of the target formation as a result of improved logging techniques has enhanced directional drilling capabilities. As directional drilling capabilities have improved, so have the expectations for drilling performance. For example, a driller today may target a relatively narrow, horizontal oil-bearing stratum, and may wish to maintain the borehole completely within the stratum. In some complex scenarios, highly specialized "design drilling" techniques with highly tortuous well paths having multiple directional changes of two or more bends lying in different planes may be employed.

One common method to control the drilling direction of a bit is to steer the bit using a downhole motor with a bent sub and/or housing. As shown in FIG. 1, a simplified version of a downhole steering system according to the prior art comprises a rig 1, a drill string 2 having a downhole motor 6 with a bent sub 4, and a conventional drill bit 8. Motor 6 and bent sub 4 form part of the bottomhole assembly (BHA) and are attached to the lower end of the drill string 2 adjacent the conventional drill bit 8. When not rotating, the bent sub 4 causes the bit face to be canted with respect to the tool axis. The downhole motor 6 is capable of rotating conventional drill bit 8 without the need to rotate the entire drill string 2. For example, downhole motor 6 may be a turbine, an electric motor, or a progressive cavity motor that converts drilling fluid pressure pumped down drill string 2 into rotational energy at drill bit 8. When downhole motor 6 is used with bent sub 6 without rotating drill string 2, drill bit 8 drills a borehole that is deviated in the direction of the bend or curve in the bent sub 6. On the contrary, when the drill string is also rotated, the borehole normally maintains a linear path or direction, even when a downhole motor is used, since the bent sub or housing rotates along with the drill string, and thus, no longer orients the drill bit in a specific direction. Consequently, a combination of a bent sub or housing and a downhole motor to rotate the drill bit without rotating the still string generally provide a more effective means for deviating a borehole.

When a well is deviated from vertical by several degrees and has a substantial inclination, such as greater than 30 degrees, the factors typically influencing drilling and steering may have a reduced impact. For instance, operational parameters such as weight on bit (WOB) and RPM typically have a large influence on the bit's ROP, as well as its ability to achieve and maintain the required well bore trajectory. However, as the inclination of the well increases towards horizontal, it becomes more difficult to apply weight on bit effectively since the borehole bottom is no longer aligned with the force of gravity—increasing bends in the drill string tend to reduce the amount of downward force applied to the string at the surface that is translated to WOB acting at the bit face. In some cases, the application of sufficient downward forces at the surface to a bent drill string may lead to buckling or deformation of the drill string. Consequently, directional drilling with a combination of a downhole motor and a bent sub may decrease the effective WOB, and thus, may reduce the achievable ROP.

In addition, as previously described, directional drilling with a downhole motor coupled with a bent sub is preferably performed without rotating the drill string in a process commonly referred to as "sliding." However, in drilling operations where the drill string is not rotating, or is rotated very little, the rotational shear acting on the drilling fluid in the annulus between the drill string and borehole wall is decreased, as compared to a case where the entire drill string is rotating. Since drilling fluids tend to be thixotropic, the reduction or complete loss of the shearing action tends to adversely affect the ability of the drilling fluid to flush and carry away cuttings from the borehole. As a result, in deviated holes drilled with a downhole motor and bent sub alone, formation cuttings are more likely to settle out of the drilling fluid on the bottom or low side of the borehole. This may increase borehole drag, making weight-on-bit transmission to the bit even more difficult, and often resulting in tool phase control and prediction problems. These challenges encountered in sliding can result in an inefficient and time consuming operation.

Still further, drilling with the downhole motor and bent sub during a sliding operation deprives the driller of the use of a significant source of rotational energy and power, namely the surface equipment that is otherwise employed to rotate the drill string. In directional drilling cases employing a downhole motor powered by drilling fluid pressure (e.g., progressive cavity motor), the large pressure drop across the downhole motor consumes a significant portion of the energy of the drilling fluid, and may detrimentally reduce the hydraulic capabilities of the drilling fluid advanced to the bit face and borehole bottom. In other words, the large pressure drop across the motor results in a lower drilling fluid pressure at the bit face, potentially decreasing the ability of the drilling fluid to clean and cool the cutter elements on the bit face, and flush away cutting from the borehole bottom. To the contrary, when surface equipment is employed to rotate the drill string and the bit, rotational energy and power are directly translated to the bit, without the need to convert drilling fluid pressure to rotational energy. Consequently, the use of surface equipment to rotate a drill string and bit may result in increased ROP and improved bit hydraulics as compared to a bit rotated by a downhole motor alone.

In addition to deviating from vertical in directional drilling operations as shown in FIG. 1, it may also be desirable to have a drill bit capable of returning to a vertical drilling orientation in the event the drill bit inadvertently deviates from vertical. The ability of a bit to return to a vertical path after deviating from such a path is generally referred to as "dropping". In order to effect dropping, a drill bit must have the capability of drilling or penetrating the earth in a direction not parallel with the longitudinal axis of the bit.

As shown in the schematic view of FIG. 2, a drillstring assembly 50 including a drill string 53 and a bit 51 is shown drilling a borehole 55 that has deviated from vertical. Drillstring assembly 50 has a weight vector 52 that consists of an axial component 54 and a radial or normal component 56. Unlike the directional drilling operations described above in which deviations from vertical are desired, in some cases, deviations from vertical are unintentional or inadvertent. In such cases, it may be desirable to return drilling assembly 50 to a vertical orientation while drilling. To effect such a return to vertical, drill bit 51 must drill in a direction that is not parallel to axial vector 54. This may be accomplished by cutting and removing formation material from a sidewall 57 of borehole 55.

Accordingly, there remains a need in the art for an apparatus or system capable of altering the azimuth or inclination of a drill bit and well without relying solely on a downhole motor or rotary steerable device. Such an apparatus would be particularly well received if it was capable of altering the direction of the drill string and borehole trajectory in a controlled manner while maintaining the rotation of the entire drill string. In addition, it is desired that this change in direction be achieved with a drill bit having predetermined dropping tendencies, regardless of formation type, lithology, well trajectory, stratigraphy, or formation dip angles.

SUMMARY OF THE DISCLOSURE

In accordance with at least one embodiment of the invention, a drill bit for drilling a borehole in earthen formations comprises a bit body having a bit axis and a bit face. In addition, the bit comprises a pin end extending from the bit body opposite the bit face. Further, the bit comprises a plurality of gage pads extending from the bit body, wherein each gage pad includes a radially outer gage-facing surface. The gage-facing surfaces of the plurality of gage pads define a gage pad circumference that is centered relative to a gage pad axis, the gage pad axis being substantially parallel to the bit axis and offset from the bit axis.

In accordance with other embodiments of the invention, a drill bit for drilling a borehole comprises a bit body having a bit axis and a bit face including a cone region, a shoulder region, and a gage region. In addition, the bit comprises a pin end opposite the face region. Further the bit comprises a first blade and a second blade, each blade radially extending along the bit face and having a first end in the cone region and a second end in the gage region. Still further, the bit comprises a first gage pad having a gage-facing surface and extending from the second end of the first blade. Moreover, the bit comprises a second gage pad having a gage-facing surface and extending from the second end of the second blade. The gage-facing surface of the first gage pad and the gage-facing surface of the second gage pad are each substantially equidistant from a gage pad axis that is offset from the bit axis.

In accordance with another embodiment of the invention, a drill bit for drilling a borehole having a predetermined full gage diameter comprises a bit body having a bit axis and a bit face. In addition, the bit comprises a pin end extending from the bit body opposite the bit face, the pin end being concentric about the bit axis. Further, the bit comprises a cutting structure on the bit face extending to the full gage diameter. Still further, the bit comprises a plurality of $N_1$ gage pads disposed about the bit body, each of the $N_1$ gage pads including a gage-facing surface, wherein the gage-facing surfaces on the $N_1$ gage pads are concentric about a gage pad axis that is parallel to the bit axis and offset from the bit axis.

Thus, embodiments described herein comprise a combination of features and advantages intended to address various shortcomings associated with certain prior devices. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a more detailed description of the preferred embodiments, reference will now be made to the accompanying drawings, wherein.

DETAILED DESCRIPTION OF SOME OF THE PREFERRED EMBODIMENTS

Figure 1:
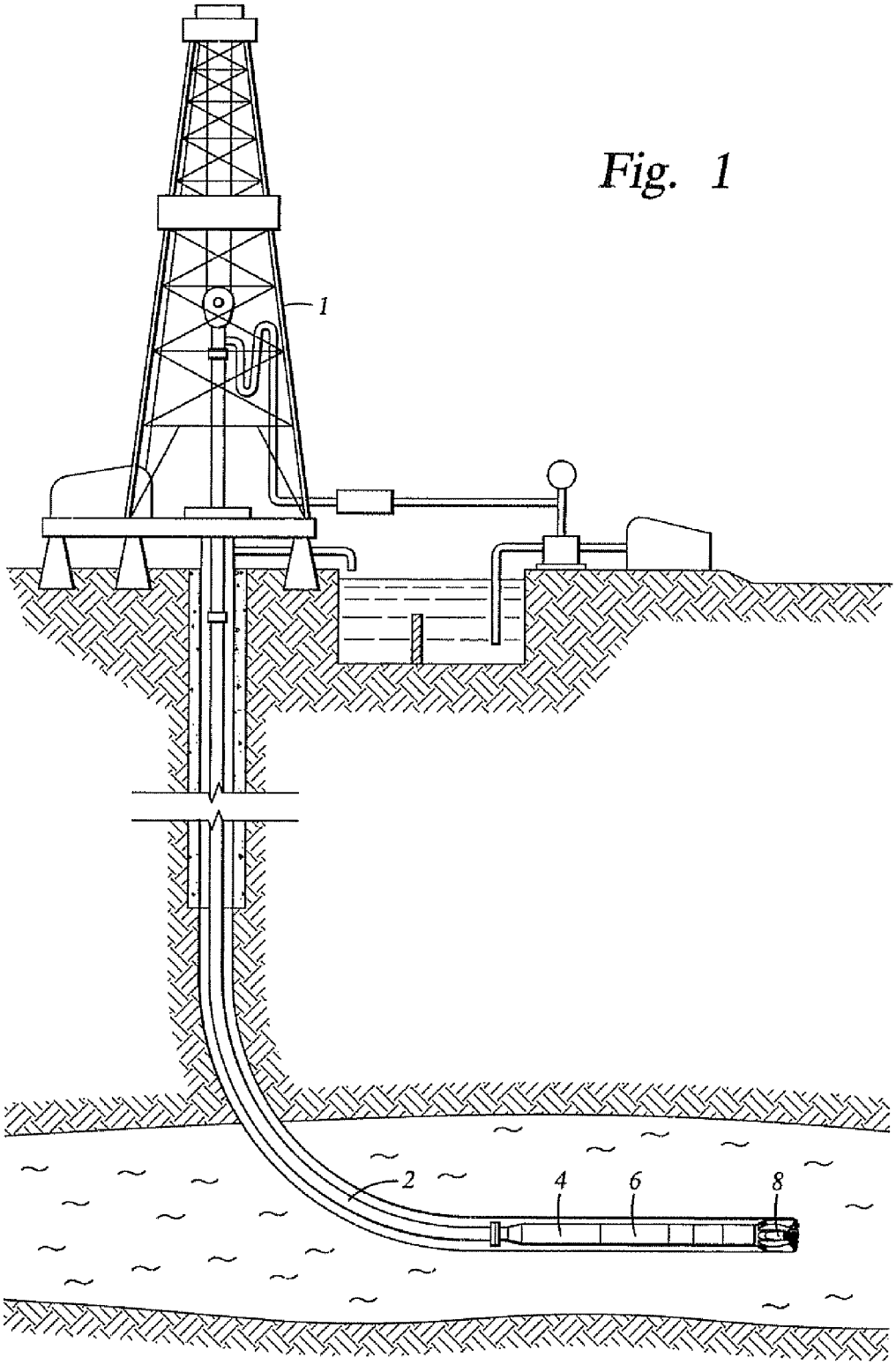
FIG. 1 is a schematic view of a conventional drilling system.
Figure 2:
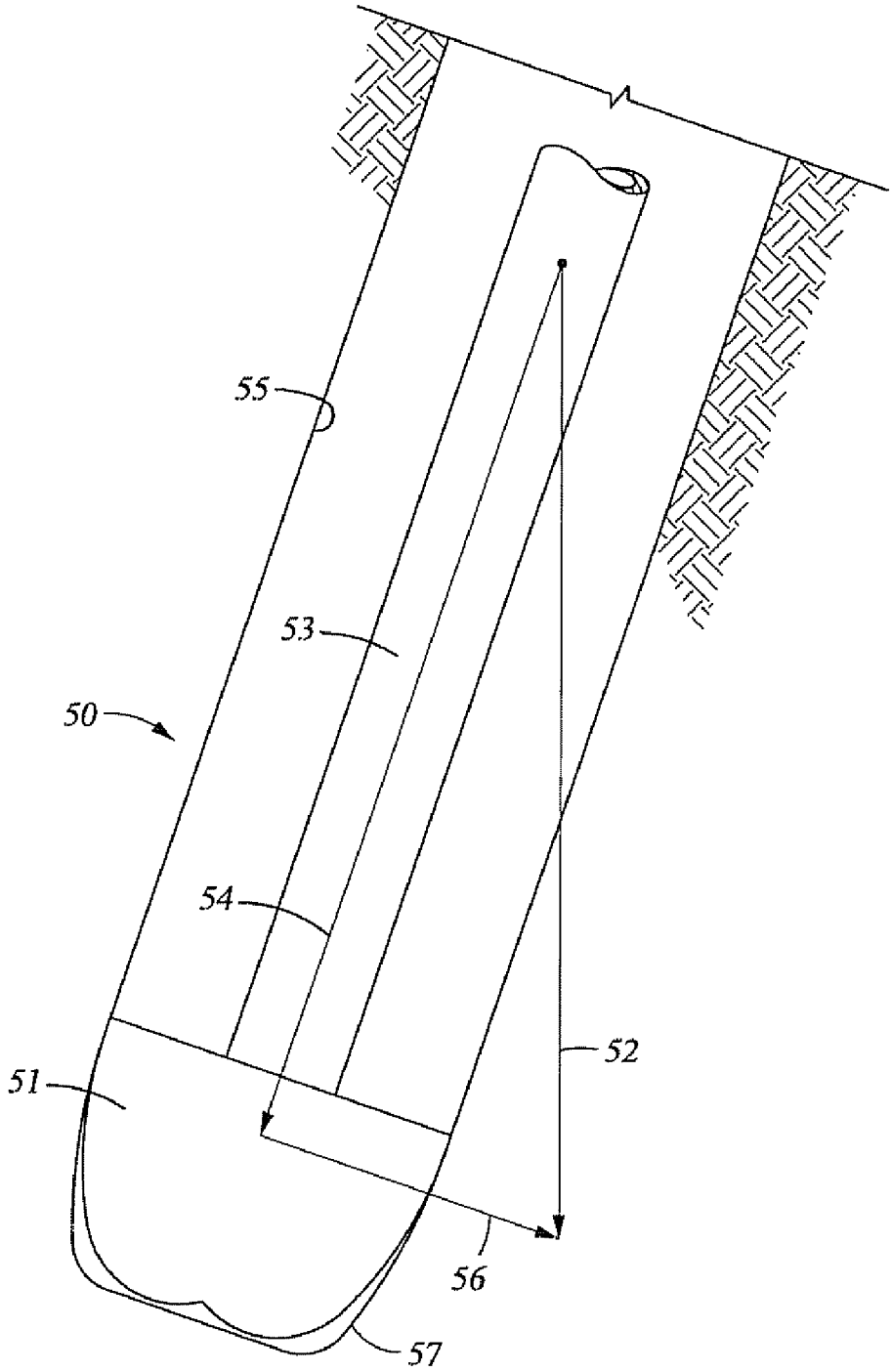
FIG. 2 is a schematic view of a prior art drill bit on a drill string.

The following discussion is directed to various embodiments. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections.

Figure 3:
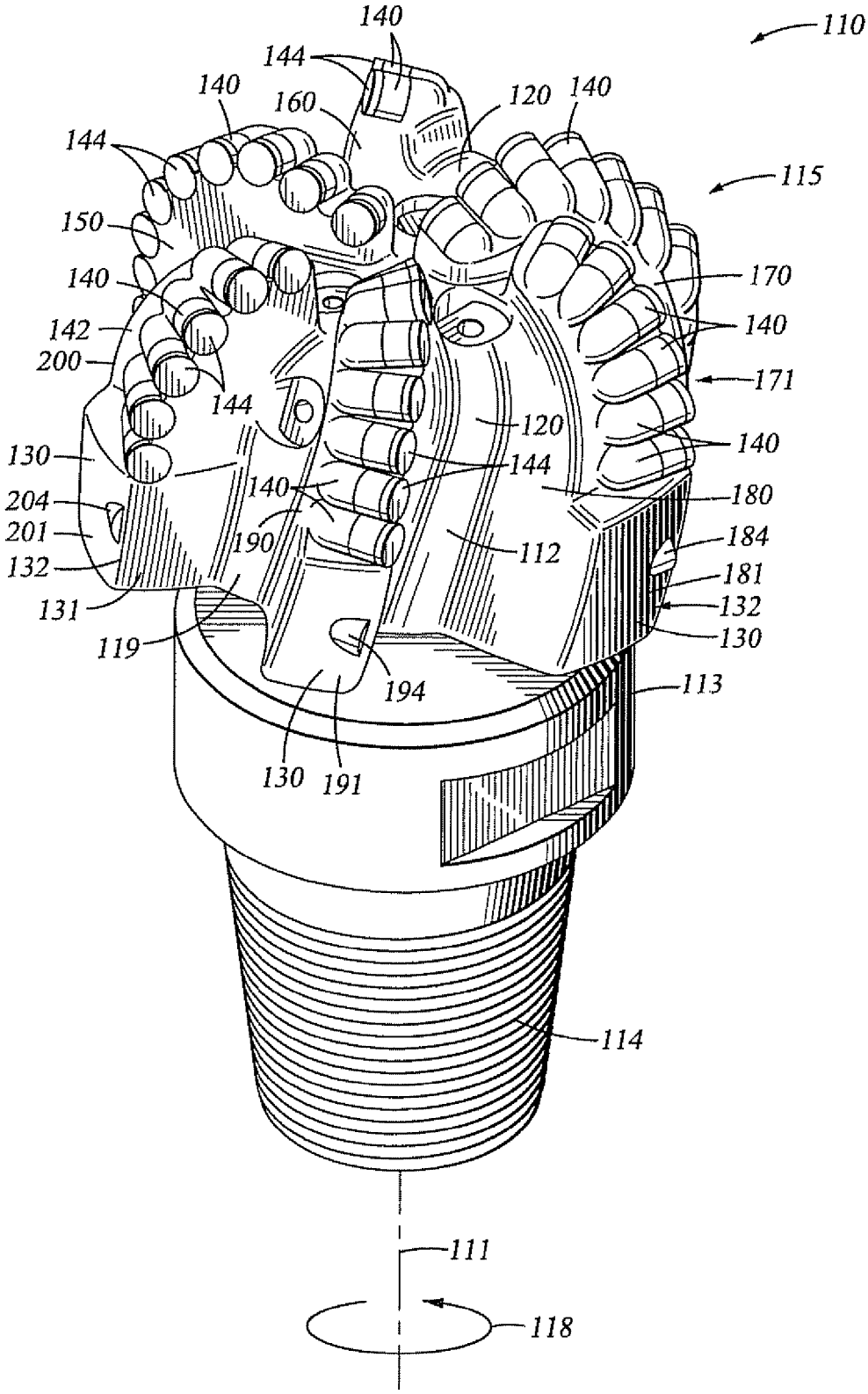
FIG. 3 is a perspective view of an embodiment of a bit made in accordance with the principles described herein.
Figure 4:
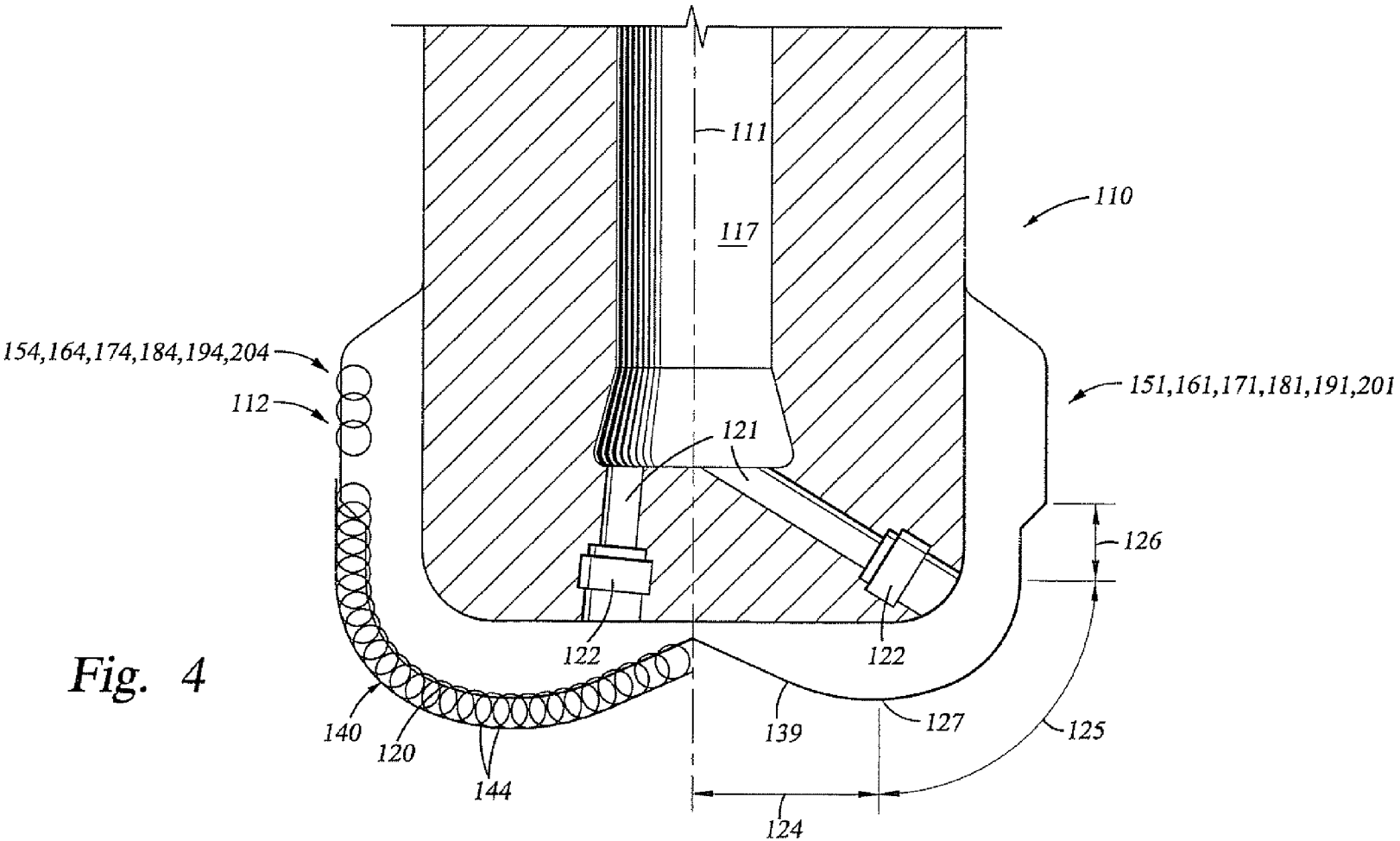
FIG. 4 is a partial cross-sectional view of the bit shown in FIG. 3 with the cutter elements of the bit shown rotated into a single profile.

Referring to FIGS. 3 and 4, an embodiment of a drill bit 110 is a fixed cutter bit, sometimes referred to as a drag bit, and is preferably a PD bit adapted for drilling through formations of rock to form a borehole. Bit 110 generally includes a bit body 112, a shank 113, and a threaded connection or pin end 114 for connecting bit 110 to a drill string (not shown), which is employed to rotate the bit in order to drill the borehole. Bit 110 and pin end 114 include a bit axis 111 about which bit 110 rotates in the cutting direction represented by arrow 118. Bit body 112 has a bit face 120 that supports a cutting structure 115 and is formed on the end of bit 110 generally opposite pin end 114. Body 112 may be formed in a conventional manner using powdered metal tungsten carbide particles in a binder material to form a hard metal cast matrix. Alternatively, the body can be machined from a metal block, such as steel, rather than being formed from a matrix.

As best seen in FIG. 4, body 112 includes a central longitudinal bore 117 permitting drilling fluid to flow from the drill string into bit 110. Body 112 is also provided with downwardly extending flow passages 121 having ports or nozzles 122 disposed at their lowermost ends. The flow passages 121 are in fluid communication with central bore 117. Together, passages 121 and nozzles 122 serve to distribute drilling fluids around cutting structure 115 to flush away formation cuttings during drilling and to remove heat from bit 110.

Referring now to FIGS. 3-6, cutting structure 115 is provided on bit face 120 of bit 110. Cutting structure 115 includes a plurality of blades which extend radially along bit face 120. In the embodiment illustrated in FIGS. 3-6, cutting structure 115 includes six blades 150, 160, 170, 180, 190, 200 that are angularly spaced-apart about bit axis 111. In particular, in this embodiment, blades 150, 160, 170, 180, 190 and 200 are uniformly angularly spaced about 60° apart on bit face 120. In other embodiments, one or more of the blades may be non-uniformly angularly spaced relative to the bit axis. Although bit 110 is shown as having six blades 150, 160, 170, 180, 190 and 200, in general, bit 110 may comprise any suitable number of blades. As one example only, bit 110 may comprise eight blades.

In this embodiment, blades 150, 160, 170, 180, 190, 200 are integrally formed as part of, and extend from, bit body 112 and bit face 120. Further, blades 150, 160, 170, 180, 190, 200 extend radially outward along bit face 120 and then axially along a portion of the periphery of bit 110. Blades 150, 160, 170, 180, 190 and 200 are separated by drilling fluid flow courses 119. As used herein, the terms "axial" and "axially" generally mean along or parallel to the bit axis (e.g., bit axis 111), while the terms "radial" and "radially" generally mean perpendicular to the bit axis. For instance, an axial distance refers to a distance measured parallel to the bit axis, and a radial distance means a distance measured perpendicular from the bit axis.

Referring still to FIGS. 3-6, each blade 150, 160, 170, 180, 190, 200 includes a cutter-supporting surface 142 for mounting a plurality of cutter elements 140. Cutter elements 140 each include a cutting face 144 having a cutting edge adapted to engage and remove formation material. The cutting edge of one or more cutting faces 144 may be chamfered or beveled as desired. Although cutter elements 140 are shown as being arranged in radially extending rows, cutter elements 140 may be mounted in other suitable arrangements including, without limitation, arrays or organized patterns, randomly, sinusoidal pattern, or combinations thereof. Further, in other embodiments, one or more trailing backup rows of cutter elements may be provided on one or more of the blades.

Bit 110 further includes gage pads 151, 161, 171, 181, 191, 201 of substantially equal axial length in this embodiment. Gage pads 151, 161, 171, 181, 191, 201 are generally disposed about the outer circumference of bit 110 at angularly spaced apart locations. Specifically, each gage pad 151, 161, 171, 181, 191, 201 intersect and extends from one of the blades 150, 160, 170, 180, 190 and 200, respectively. Gage pads 151, 161, 171, 181, 191, 201 are each integrally formed as part of the bit body 112.

Each gage pad 151, 161, 171, 181, 191, 201 includes a radially outer formation or gage-facing surface 130 and a generally forward-facing surface 131 which intersect in an edge 132, which may be radiused, beveled or otherwise rounded. Each gage-facing surface 130 includes at least a portion that extends in a direction generally parallel to axis 111. As used herein, the phrase "gage-facing surface" refers to the radially outer surface of a gage pad that generally faces the formation. It should be appreciated that in some embodiments, portions of one or more gage-facing surface 130 may be angled, and thus slant away from the borehole sidewall. Also, in select embodiments, one or more forward-facing surface 131 may likewise be angled relative to bit axis 111 (both as viewed perpendicular to axis 111 or as viewed along axis 111). Thus, gage-facing surface 130 need not be perfectly parallel to the formation, but rather, may be oriented at an acute angel relative to the formation. Surface 131 is termed "forward-facing" to distinguish it from gage-facing surface 130, which generally faces the borehole sidewall. A gage trimmer 154, 164, 174, 184, 194, 204 is mounted to each gage pad 151, 161, 171, 181, 191, 201, respectively. In particular, in this embodiment, one gage trimmer 154, 164, 174, 184, 194, 204 extends from the gage-facing surface 130 of each gage pad 151, 161, 171, 181, 191, 201, respectively. However, in other embodiments, none or more than one gage trimmer may be provided on one or more of the gage pads.

Referring specifically to FIG. 4, an exemplary profile of bit 110 is shown as it would appear with all blades (e.g., blades 150, 160, 170, 180, 190, 200), all cutter elements 140, and all gage trimmers 154, 164, 174, 184, 194, 204 rotated into a single rotated profile. In rotated profile view, blades 150, 160, 170, 180, 190, 200 of bit 110 form a combined or composite blade profile 139 generally defined by cutter-supporting surface 142 of each blade. Composite blade profile 139 and bit face 120 may generally be divided into three regions conventionally labeled cone region 124, shoulder region 125, and gage region 126. Each region 124, 125, 126 is generally concentric with and centered relative to bit axis 111.

Referring still to FIG. 4, cone region 124 comprises the radially innermost region of bit 110 and composite blade profile, and extends radially from bit axis 111 to shoulder region 125. In this embodiment, cone region 124 is generally concave. Radially adjacent cone region 124 is shoulder (or the upturned curve) region 125. In this embodiment, shoulder region 125 is generally convex. The transition between cone region 124 and shoulder region 125 occurs at the axially outermost portion of composite blade profile 139 (lowermost point on bit 110 in FIG. 4), which is typically referred to as the nose or nose region 127. Moving radially outward from bit axis 111, next to shoulder region 125 is gage region 126 which extends substantially parallel to bit axis 111 at the outer radial periphery of composite blade profile 139. In this embodiment, each gage pad 151, 161, 171, 181, 191, 201 generally axially from one of the blades 150, 160, 170, 180, 190, 200, respectively.

In general, the geometry, orientation, and placement of the plurality of blades on a fixed cutter bit can be varied relative to each other to enhance the ability of the bit to drill off-axis. In some cases, directional drilling capabilities can be enhanced by employing blades with non-uniform or non-identical configurations. Bits incorporating such non-uniform blade designs are disclosed in U.S. Pat. Nos. 5,937,958 and 6,308,970, each of which is hereby incorporated herein by reference in its entirety. As will be explained in more detail below, in the embodiments of bit 110 disclosed herein, the radial location and orientation of gage pads 151, 161, 171, 181, 191, 201 are configured to offer the potential for bit 110 to drill off-axis.

Figure 5:
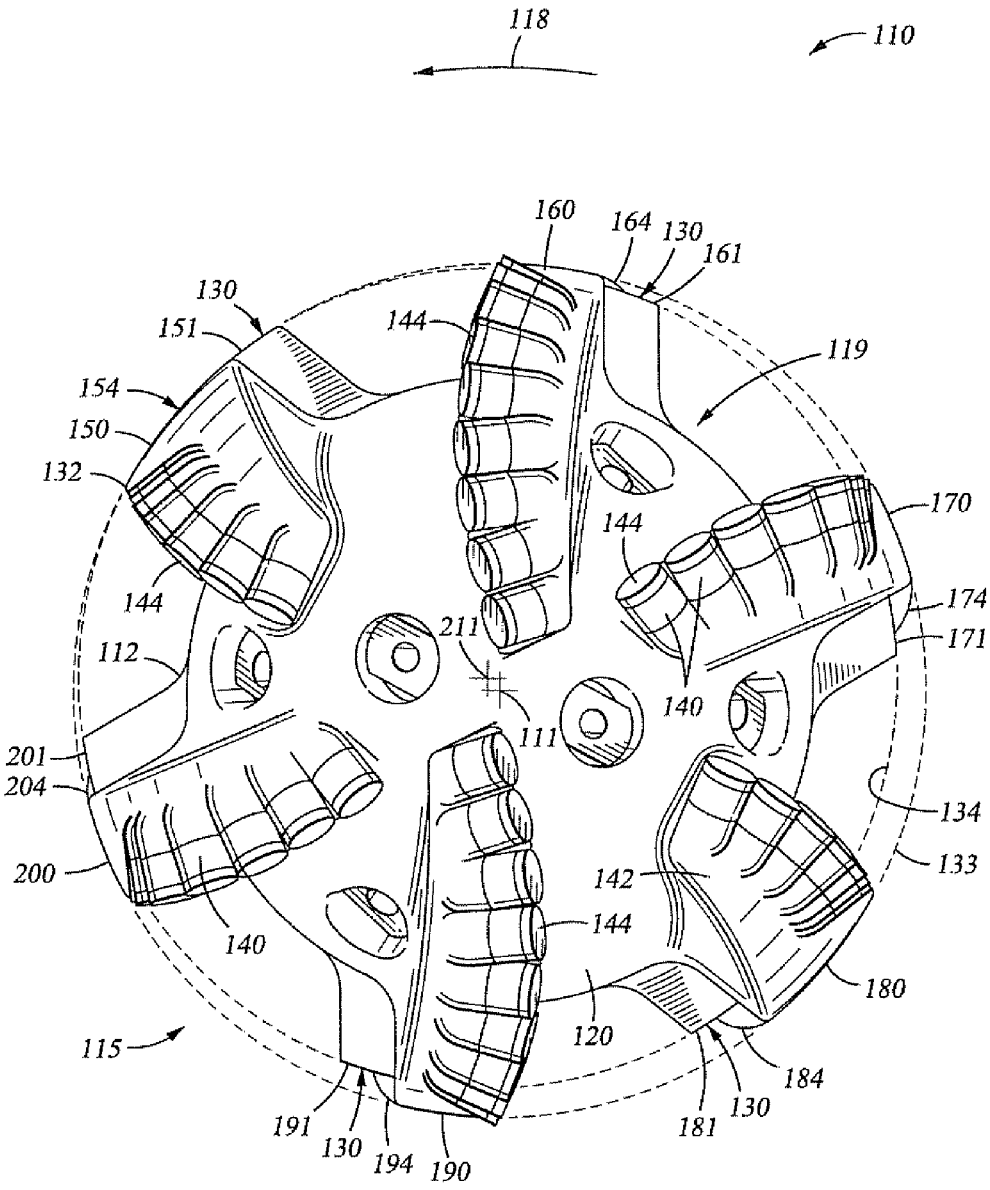
FIG. 5 is an axial cutting face end view of the drill bit of FIG. 3.
Figure 6:
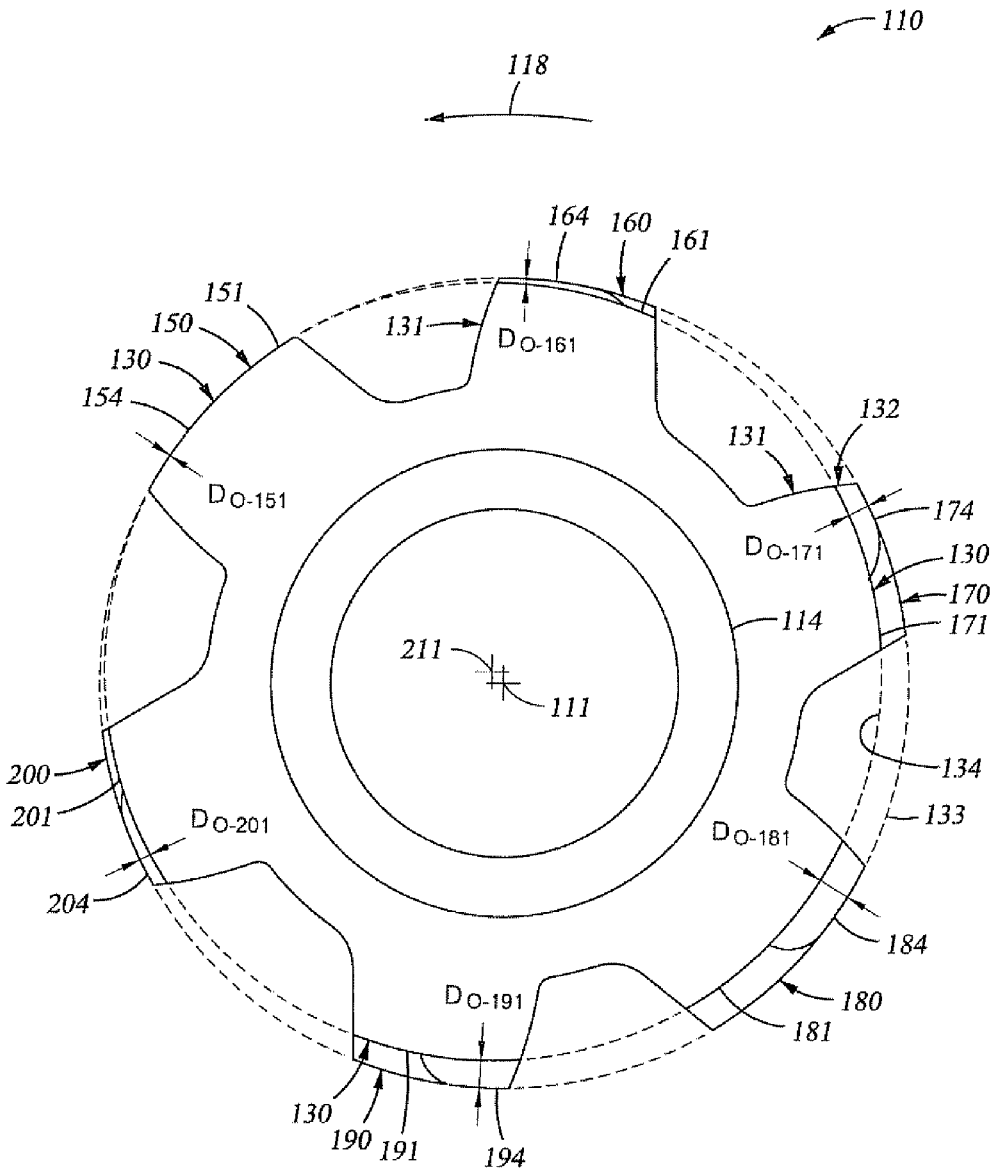
FIG. 6 is an axial pin end view of the drill bit of FIG. 3.

Referring now to FIGS. 5 and 6, the radially outermost surfaces and edges of bit 110 circumscribe and define a full bit circumference 133 (also known as a full gage diameter). In this embodiment, full bit circumference 133 represents the circle circumscribed by the cutting edges of the radially outermost cutter elements 140 and gage trimmers 154, 164, 174, 184, 194, 204. In addition, gage-facing surfaces 130 of gage pads 151, 161, 171, 181, 191, 201 circumscribe and define a gage pad diameter or circumference 134.

In this embodiment, pin end 114 and full bit circumference 133 are centered relative to bit axis 111. However, gage pad circumference 134 is not centered relative to bit axis 111. Rather, gage pad circumference 134 is concentric with, and centered relative to, a gage pad axis 211 that is substantially parallel to, but offset from (i.e., not collinear), bit axis 111. In this sense, gage pad circumference 134 may be described as being offset from full bit circumference 133. In other words, full bit circumference 133 defining the full gage diameter is not concentric with gage pad circumference 134. Gage pad axis 211 may also be referred to herein as an "offset axis" since it is generally parallel with, but offset from, bit axis 111.

Referring still to FIGS. 5 and 6, due to the configuration of full bit circumference 133 and gage pad circumference 134, the gage-facing surface 130 of select gage pads are disposed at full bit circumference 133, while the gage-facing surface 130 of other gage pads are radially inward or recessed relative to full bit circumference 133. For example, gage-facing surface 130 of gage pad 151 is located substantially at full bit circumference 133, while gage-facing surface 130 of remaining gage pads 161, 171, 181, 191, 201 are radially inward or recessed from full bit circumference. In other words, gage-facing surface 130 of gage pads 161, 171, 181, 191, 201 are not disposed at full bit circumference 133. For purposes of clarity and explanation, the differences in the diameters of full bit circumference 133 and gage pad circumference 134 have been exaggerated in FIGS. 5 and 6.

The amount or degree of radial offset from full bit circumference 133 of gage-facing surface 130 of each gage pad 151, 161, 171, 181, 191, 201 may be described by offset distances $D_{o\text{-}151}$, $D_{o\text{-}161}$, $D_{o\text{-}171}$, $D_{o\text{-}181}$, $D_{o\text{-}191}$, $D_{o\text{-}201}$, respectively, measured between the particular gage-facing surface 130 and the full bit circumference 133 generally perpendicular to the particular gage-facing surface 130. Thus, as used herein, the phrase "offset distance" may be used to refer to the distance between a gage-facing surface of a gage pad and the full bit circumference as measured perpendicular to the gage-facing surface. It should be appreciated that the radial offset distance of a particular gage-facing surface (e.g., gage-facing surface 130) may not be constant along its entire circumferential length. Thus, as used herein, the "offset distance" of a gage-facing surface refers to the maximum offset distance for the particular gage-facing surface relative to the full bit circumference. Still further, it should be appreciated that a gage-facing surface (e.g., gage-facing surface 130) disposed substantially at the full bit circumference (e.g., full bit circumference 133) is not offset from the full bit circumference, and thus, has an offset distance of zero relative to the full bit circumference.

Referring still to FIGS. 5 and 6, gage-facing surface 130 of gage pad 181 has the greatest offset distance $D_{o\text{-}181}$. In other words, offset distance $D_{o\text{-}181}$ of gage pad 181 is greater than offset distances $D_{o\text{-}151}$, $D_{o\text{-}161}$, $D_{o\text{-}171}$, $D_{o\text{-}191}$, $D_{o\text{-}201}$ of remaining gage pads 151, 161, 171, 191, 201, respectively. In addition, gage-facing surface 130 of gage pad 151 has an offset distance $D_{o-151}$ that is less than offset distances $D_{o-161}$, $D_{o-171}$, $D_{o-181}$, $D_{o-191}$, $D_{o-201}$ of remaining gage pads 161, 171, 181, 191, 201, respectively. In particular, gage-facing surface 130 of gage pad 151 is disposed substantially at full bit circumference 133, and thus, has a radial offset distance $D_{o-151}$ of zero. Offset distances $D_{o-171}$, $D_{o-191}$, are each greater than offset distances $D_{o-161}$, $D_{o-201}$. The offset distance $D_{o-151}$, $D_{o-161}$, $D_{o-171}$, $D_{o-181}$, $D_{o-191}$, $D_{o-201}$ of each gage pad 151, 161, 171, 181, 191, 201, respectively, may be varied depending on a variety of factors including, without limitation, the application, the bit size, the desired side cutting capability, or combinations thereof. Each offset distance $D_{o-151}$, $D_{o-161}$, $D_{o-171}$, $D_{o-181}$, $D_{o-191}$, $D_{o-201}$ is preferably between zero and 0.20 in.

Although certain gage-facing surfaces 130 do not extend to full bit circumference 133, the radially outermost cutting edge of each gage trimmer 154, 164, 174, 184, 194, 204 does extend from its respective gage pad 151, 161, 171, 181, 191, 201, respectively, to full bit circumference 133. In other words, the outermost cutting tips of each gage trimmer 154, 164, 174, 184, 194, 204 circumscribes full bit circumference 133 even though the formation-facing surface 130 from which it extends is offset from full bit circumference 133. Consequently, the distance that each gage trimmer 154, 164, 174, 184, 194, 204 extends from its gage pad 151, 161, 171, 181, 191, 201, respectively, will depend on the position of gage facing surface 130 to which it is mounted. For example, formation-facing surfaces 130 of blades 170, 180 are disposed further from full bit circumference 133 than formation-facing surfaces 130 of blades 150 and 160. Consequently, gage trimmers 174, 184 associated with blades 170, 180, respectively, extend farther from their respective gage-facing surface 130 than gage trimmers 154, 164 associated with blades 150, 160, respectively.

In general, each gage-trimmer (e.g., gage-trimmer 154, 164, 174, 184, 194, 204) extends from its gage pad (e.g., gage pad 151, 161, 171, 181, 191, 201) to an extension height measured perpendicularly from the gage-facing surface to the outermost point of the gage-trimmer. As previously described, in this embodiment, each gage-trimmer 154, 164, 174, 184, 194, 204 extends from gage-facing surface 130 of gage pads 151, 161, 171, 181, 191, 201, respectively, to full bit circumference 133. Thus, in this embodiment, the extension height of each gage-trimmer 154, 164, 174, 184, 194, 204 is substantially the same as the offset distance $D_{o-151}$, $D_{o-161}$, $D_{o-171}$, $D_{o-181}$, $D_{o-191}$, $D_{o-201}$, respectively. As previously described, each offset distance $D_{o-151}$, $D_{o-161}$, $D_{o-171}$, $D_{o-181}$, $D_{o-191}$, $D_{o-201}$ is preferably between zero and 0.20 in. Accordingly, in this embodiment, the extension height of each gage-trimmer 154, 164, 174, 184, 194, 204 is preferably between zero and 0.20 in. In one embodiment, the extension height of at least one gage trimmer is preferably at least 0.025 in., and more preferably between 0.025 in. and 0.20 in.

The differences in the extension heights of gage trimmers 154, 164, 174, 184, 194, 204 impact their ability to penetrate or shear the formation during drilling operations. In general, the greater the extension height of a cutter element or gage trimmer, the greater the potential depth of penetration of the cutter element or gage trimmer into the formation. For instance, gage trimmer gage trimmer 174 of blade 170 has a greater extension height than gage-trimmer 204 of blade 200, and thus, has the potential to penetrate deeper into the formation than gage-trimmer 204 before gage pad 201, 171, respectively, contact the formation. In general, once a gage-trimmer has penetrated the formation to a depth substantially equal to its extension height, the gage pad to which it is mounted will begin to contact, slide, and scrape across the formation, thereby reducing the ability of the gage trimmer to further penetrate or shear the earthen formation. Without being limited by this or any particular theory, such reduction in the gage-trimmers ability to further penetrate the formation results because the forces exerted on the formation become distributed over the entire surface area of gage-facing surface (e.g., gage-facing surface 130) of the gage pad (e.g., gage pad 151) rather than being purely concentrated at the tips of the gage trimmer. Consequently, the force per unit area exerted on the formation is reduced, thereby reducing the ability of the gage trimmer to penetrate or shear the formation material. Thus, gage trimmers with greater extension heights tend to penetrate further into the formation, and hence shear the formation more effectively, as compared to gage trimmers with smaller extension heights.

In the embodiment shown in FIGS. 5 and 6, gage trimmer 184 has the greatest extension height, followed by gage-trimmers 174, 194, which in turn, have greater extension heights than gage-trimmers 164, 204. As previously described, gage-facing surface 130 of gage pad 151 is disposed substantially at full gage circumference, and thus, gage-trimmer 154 has the an extension height of about zero—the smallest extension height of any of gage-trimmer.

In this manner, embodiments of bit 110 include gage trimmers 154, 164, 174, 184, 194, 204 having different extension heights and different formation penetrating capabilities. In general, the greater the extension height of the gage trimmer, the greater its formation engaging and cutting ability. Thus, by selectively controlling the extension height of gage trimmers 154, 164, 174, 184, 194, 204, the formation penetrating ability and cutting effectiveness of each gage trimmer 154, 164, 174, 184, 194, 204 may be varied and controlled.

Referring still to FIG. 4, cone region 124 comprises the radially innermost region of bit 110 and composite blade profile, and extends radially from bit axis 111 to shoulder region 125. In this embodiment, cone region 124 is generally concave. Radially adjacent cone region 124 is shoulder (or the upturned curve) region 125. In this embodiment, shoulder region 125 is generally convex. The transition between cone region 124 and shoulder region 125 occurs at the axially outermost portion of composite blade profile 139 (lowermost point on bit 110 in FIG. 4), which is typically referred to as the nose or nose region 127. Moving radially outward from bit axis 111, next to shoulder region 125 is gage region 126 which extends substantially parallel to bit axis 111 at the outer radial periphery of composite blade profile 139. In this embodiment, each gage pad 151, 161, 171, 181, 191, 201 generally extends axially from one of the blades 150, 160, 170, 180, 190, 200, respectively.

Without being limited by this or any particular theory, for a drill bit without gage cutter relief (e.g., a drill bit without gage-trimmers extending from the gage-facing surface), the radial, restoring forces urging the drill bit back to the vertical orientation may not be sufficient to activate side cutting of the borehole sidewall and allow the bit to return to the vertical drilling direction. Instead, such restoring forces will be distributed across the relatively large surface area of the gage-facing surfaces, thereby reducing the force per unit area acting on the borehole sidewall. However, embodiments described herein (e.g., embodiments of bit 110) include gage trimmers (e.g., gage trimmers 164, 174, 184, 194, 204) that extend from their respective gage pad (e.g., gage pads 161, 171, 181, 191, 201). In such embodiments, the radial, restoring forces, acting on the bit are, at least initially, concentrated at the tips of the gage-trimmers, each having a relatively small surface area. The force per unit area exerted on the formation by such gage-trimmers may exceed the formation strength, and thus, begin to shear the borehole sidewall and activate side cutting in the direction of the radial, restoring force. Consequently, embodiments of bit 110 offer the potential for drilling and formation penetration in a direction that is not parallel with the longitudinal axis 111 of bit 110. More specifically, embodiments of bit 110 offer the potential for a drill bit that tends to return to a vertical upon deviation therefrom. It should also be appreciated that in addition to the weight vector of the drill string acting on the drill bit, a bending moment in the drill string may also urge the drill bit into the lower side of the borehole in the direction of zero deviation from vertical.

The nature of a PDC cutting structure layout (e.g., blades and cutter elements) typically results in an asymmetric distribution of forces about the bit. In some cases, such asymmetric forces can lead to force imbalances that may result in bit vibrations, or possibly bit whirl. As previously described, vibrations and bit whirl can lead to unpredictable, and potentially damaging, forces acting on the cutter elements and gage-trimmers, particularly, during side cutting and directional drilling operations. However, asymmetric gage pad circumference 134 and non-uniform extension heights of gage-trimmers 154, 164, 174, 184, 194, 204 of bit 110 offer the potential to resist vibration and whirl. More specifically, the positioning and orientation of each gage-facing surface 130 and each gage trimmers 154, 164, 174, 184, 194, 204 may be selected to control the loading of each gage-trimmer 154, 164, 174, 184, 194, 204. In particular, the circumferential position and radial position of each gage-facing surface 130 (i.e., offset distances $D_{o\text{-}151}$, $D_{o\text{-}161}$, $D_{o\text{-}171}$, $D_{o\text{-}181}$, $D_{o\text{-}191}$, $D_{o\text{-}201}$), as well as the extension height of each gage-trimmer 154, 164, 174, 184, 194, 204 may be designed and configured to minimize the imbalance forces generated by cutting structure 115. For instance, in an embodiment, the circumferential position of each gage pad 151, 161, 171, 181, 191, 201 relative to full gage circumference 133, the offset distances $D_{o\text{-}151}$, $D_{o\text{-}161}$, $D_{o\text{-}171}$, $D_{o\text{-}181}$, $D_{o\text{-}191}$, $D_{o\text{-}201}$ of each gage-facing surface 130, and the extension heights 154, 164, 174, 184, 194, 204 of each gage-trimmer 154, 164, 174, 184, 194, 204 may be selected to counteract the anticipated imbalance forces generated by cutting structure 115. Such a bit with minimized net imbalanced forces offers the potential for reduced vibrations and whirl, and hence, more durability. In another embodiment, the circumferential position of each gage pad 151, 161, 171, 181, 191, 201 relative to full gage circumference 133, the offset distances $D_{o\text{-}151}$, $D_{o\text{-}161}$, $D_{o\text{-}171}$, $D_{o\text{-}181}$, $D_{o\text{-}191}$, $D_{o\text{-}201}$ of each gage-facing surface 130, and the extension heights 154, 164, 174, 184, 194, 204 of each gage-trimmer 154, 164, 174, 184, 194, 204 may be selected to enhance side cutting tendencies of cutting structure 115.

Various techniques may be employed to manufacture the embodiment of FIGS. 5 and 6. For example, bit 110 can be cast so that gage pads 151, 161, 171, 181, 191, 201 extend to full bit circumference 133 and are then selectively recessed from full bit circumference 133 by grinding or machining. Alternatively, bit 110 can be cast such that gage pads 151, 161, 171, 181, 191, 201 are recessed from full bit circumference 133 without subsequent manufacturing processes.

While specific embodiments have been shown and described, modifications thereof can be made by one skilled in the art without departing from the scope or teaching herein. The embodiments described herein are exemplary only and are not limiting. For example, embodiments described herein may be applied to any bit layout including, without limitation, single set bit designs where each cutter element has unique radial position along the rotated cutting profile, plural set bit designs where each cutter element has a redundant cutter element in the same radial position provided on a different blade when viewed in rotated profile, forward spiral bit designs, reverse spiral bit designs, or combinations thereof. In addition, embodiments described herein may also be applied to straight blade configurations or helix blade configurations. Many other variations and modifications of the system and apparatus are possible. For instance, in the embodiments described herein, a variety of features including, without limitation, the number of blades (e.g., primary blades, secondary blades, etc.), the spacing between cutter elements, cutter element geometry and orientation (e.g., backrake, siderake, etc.), cutter element locations, cutter element extension heights, cutter element material properties, or combinations thereof may be varied among one or more primary cutter elements and/or one or more backup cutter elements. Accordingly, the scope of protection is not limited to the embodiments described herein, but is only limited by the claims that follow, the scope of which shall include all equivalents of the subject matter of the claims.

What is claimed is:

1. A drill bit for drilling a borehole in earthen formations, the bit comprising:

a bit body having a bit axis and a bit face extending to a bit radius about the bit axis;

a pin end extending from the bit body opposite the bit face, the pin end being concentric about the bit axis;

a plurality of gage pads extending from the bit body, wherein each gage pad includes a radially outer gage-facing surface; and wherein the gage-facing surface of each of the plurality of gage pads is substantially equidistant at a gage pad radius from a gage pad axis, the gage pad axis being parallel to the bit axis and offset from the bit axis, and wherein the gage pad radius is less than the bit radius.

2. The drill bit of claim 1 further comprising:

a first gage trimmer extending from the gage-facing surface of a first gage pad to a first extension height; and a second gage trimmer extending from the gage-facing surface of a second gage pad to a second extension height that is different than the first extension height.

3. The drill bit of claim 2 wherein the first extension height is greater than the second extension height.

4. The drill bit of claim 3 wherein the first extension height is at least 0.025 in.

5. The drill bit of claim 4 wherein the first extension height is between 0.025 in, and 0.20 in.

6. The drill bit of claim 2 further comprising a cutting structure extending from the bit face, wherein the cutting structure comprises:

a plurality of blades, wherein each gage pad extends from one of the plurality of blades;

a plurality of cutter elements disposed on each of the blades, wherein the cutter elements positioned radially furthest from the bit axis define a full bit diameter; and wherein the first gage trimmer and the second gage trimmer each extend to the full bit diameter.

7. The drill bit of claim 5 wherein the first gage pad is radially offset from the full bit diameter by a first offset distance measured perpendicularly from the gage-facing surface of the first gage pad to the full bit diameter.

8. The drill bit of claim 7 wherein the first offset distance is substantially the same as the first extension height.

9. The drill bit of claim 8 wherein the first offset distance is greater than 0.025 in.

10. The drill bit of claim 7 wherein the gage-facing surface of a third gage pad is disposed substantially at the full bit diameter.

11. A drill bit for drilling a borehole comprising:

a bit body having a bit axis and a bit face including a cone region, a shoulder region, and a gage region, the bit face extending to a bit radius about the bit axis;

a pin end extending from the bit body opposite the bit face, the pin end being concentric about the bit axis;

a first blade and a second blade, each blade radially extending along the bit face and having a first end in the cone region and a second end in the gage region;

a first gage pad having a gage-facing surface and extending from the second end of the first blade;

a second gage pad having a gage-facing surface and extending from the second end of the second blade; and wherein the gage-facing surface of the first gage pad and the gage-facing surface of the second gage pad are each substantially equidistant at a gage pad radius from a gage pad axis that is offset from the bit axis and parallel to the bit axis, and wherein the gage pad radius is less than the bit radius.

12. The drill bit of claim 11 wherein the gage-facing surface of the first gage pad is disposed at a first distance from the bit axis, and the gage-facing surface of the second gage pad is disposed at a second distance from the bit axis that is greater than the first distance.

13. The drill bit of claim 12 wherein a first gage trimmer disposed on the gage-facing surface of the first gage pad has a first extension height, and a second gage trimmer disposed on the gage-facing surface of the second gage pad has a second extension height that is different from the first extension height.

14. The drill bit of claim 13 wherein the radially outermost tips of the first gage trimmer and the second gage trimmer are substantially equidistant from the bit axis.

15. The drill bit of claim 13 further comprising:

a third blade extending along the bit face and having a first end in the cone region and a second end in the gage region;

a third gage pad having a gage-facing surface and extending from the second end of the third blade;

wherein the gage-facing surface of the third gage pad is a third distance from the bit axis that is different from the first distance and the second distance.

16. The drill bit of claim 15 wherein the gage-facing surface of the first gage pad, the second gage pad, and the third gage pad are each substantially equidistant from the gage pad axis.

17. The drill bit of claim 15 wherein a third gage trimmer disposed on the gage-facing surface of the third gage pad has a third extension height that is different from the first extension height and the second extension height.

18. The drill bit of claim 17 wherein the first extension height, the second extension height, and the third extension height are each greater than or equal to zero and less than 0.20 in.

19. A drill bit for drilling a borehole having a predetermined full gage diameter, the bit comprising:

a bit body having a bit axis and a bit face;

a pin end extending from the bit body opposite the bit face, the pin end being concentric about the bit axis;

a cutting structure on the bit face extending along a bit radius to the full gage diameter;

a plurality of gage pads disposed about the bit body, wherein each of the gage pads includes a gage-facing surface, and wherein the gage-facing surfaces of all of the gage pads are concentric at a gage pad radius about a gage pad axis that is parallel to the bit axis and offset from the bit axis, and wherein the gage pad radius is less than the bit radius.

20. The drill bit of claim 19 further comprising a plurality of gage trimmers, each gage trimmer extending from the gage-facing surface of one of the plurality of gage pads, wherein each gage trimmer extends to the full gage diameter.

21. The drill bit of claim 20 wherein a plurality of the gage-facing surfaces are radially offset from the full gage diameter.

22. The drill bit of claim 21 wherein the gage-facing surface of at least one of the plurality of gage pads is disposed at the full gage diameter.

23. The drill bit of claim 21 wherein each of the gage-facing surfaces that is radially offset from the full gage diameter is radially offset from the full gage diameter by a non-uniform offset distance.

24. The drill bit of claim 19, further comprising a plurality of blades extending radially along the bit face, wherein each gage pad extends from a respective one of the plurality of blades.

25. The drill bit of claim 1, further comprising a plurality of blades extending radially along the bit face, wherein each gage pad extends from a respective one of the plurality of blades.

26. A drill bit for drilling a borehole comprising:

a bit body having a bit axis and a bit face including a cone region, a shoulder region, and a gage region;

a first blade and a second blade, each blade radially extending along the bit face and having a first end in the cone region and a second end in the gage region;

a first gage pad having a gage-facing surface and extending from the second end of the first blade; and a second gage pad having a gage-facing surface and extending from the second end of the second blade, wherein the gage-facing surface of the first gage pad and the gage-facing surface of the second gage pad are each substantially equidistant from a gage pad axis that is offset from the bit axis and parallel to the bit axis, wherein the gage-facing surface of the first gage pad is disposed at a first distance from the bit axis, and the gage-facing surface of the second gage pad is disposed at a second distance from the bit axis that is greater than the first distance, wherein a first gage trimmer disposed on the gage-facing surface of the first gage pad has a first extension height, and a second gage trimmer disposed on the gage-facing surface of the second gage pad has a second extension height that is different from the first extension height, and wherein the radially outermost tips of the first gage trimmer and the second gage trimmer are substantially equidistant from the bit axis.

27. The drill bit of claim 26, wherein the first extension height is between 0.025 inches and 0.20 inches.

28. The drill bit of claim 26, further comprising a cutting structure extending from the bit face, wherein the cutting structure comprises a plurality of cutter elements disposed on each of the blades, wherein the cutter elements positioned radially furthest from the bit axis define a full bit diameter, and wherein the first gage trimmer and the second gage trimmer each extend to the full bit diameter.

29. The drill bit of claim 28 further comprising a third blade and a third gage pad extending from the third blade, the third gage pad having a gage-facing surface disposed at the full bit diameter.

30. The drill bit of claim 1, wherein the gage pads are between the bit face and the pin end.

31. A drill bit for drilling a borehole in earthen formations, the bit comprising:

a bit body having a bit axis and a bit face;

a pin end extending from the bit body opposite the bit face, the pin end being concentric about the bit axis;

a plurality of gage pads extending from the bit body, wherein each gage pad includes a radially outer gage-facing surface, wherein the gage-facing surface of each of the plurality of gage pads is substantially equidistant from a gage pad axis, the gage pad axis being parallel to the bit axis and offset from the bit axis;

a first gage trimmer extending from the gage-facing surface of a first gage pad to a first extension height; and a second gage trimmer extending from the gage-facing surface of a second gage pad to a second extension height that is different than the first extension height.

* * * * *